US006926356B2

(12) United States Patent
Chen

(10) Patent No.: US 6,926,356 B2
(45) Date of Patent: Aug. 9, 2005

(54) PORTABLE FOLDING CHAIR

(76) Inventor: Libin Chen, Oiaoyu Building, Boyi Town, Ximenwai, Changzhou, Jiangsu 213147 (CN)

( * ) Notice: Subject to any disclaimer, the term of this patent is extended or adjusted under 35 U.S.C. 154(b) by 0 days.

(21) Appl. No.: 10/829,813

(22) Filed: Apr. 21, 2004

(65) Prior Publication Data

US 2004/0207236 A1 Oct. 21, 2004

(30) Foreign Application Priority Data

Apr. 21, 2003 (CN) ..... 03221268 U

(51) Int. Cl.[7] ..... A47C 4/28
(52) U.S. Cl. ..... 297/45; 297/35
(58) Field of Search ..... 297/45, 42, 44, 297/35

(56) References Cited

U.S. PATENT DOCUMENTS 6,264,271 B1 * 7/2001 Munn et al. ..... 297/45
6,419,311 B1 * 7/2002 Tang ..... 297/45
6,634,705 B1 * 10/2003 Zheng ..... 297/41
6,637,811 B2 * 10/2003 Zheng ..... 297/31

* cited by examiner

*Primary Examiner*—Milton Nelson, Jr.
(74) *Attorney, Agent, or Firm*—Martine Penilla & Gencarella, LLP

(57) ABSTRACT

A portable folding chair suitable for travel and leisure can be used, e.g., in households, outdoors, and in a garden. The folding chair includes a chair support frame, a surface fabric, a backrest, arms, and shoes. The chair support frame includes seating frame tubes, back-rest tubes, arm front support tubes, front support legs, front cross tubes, rear support legs, connection sliding blocks, locking sliding blocks, arm sliding blocks, rear cross tubes, locking fixtures, fixing elements, sliding locating blocks, rotating support blocks, and U-shaped hinging pieces. The front and rear support legs form an inverted V-shaped support structure when unfolded, and are drawn in when folded, because the chair is connected by cross tubes and inverted V-shaped support legs.

8 Claims, 8 Drawing Sheets

PORTABLE FOLDING CHAIR

FIELD OF THE INVENTION

This invention relates to a portable folding chair and, more particularly, to a portable folding chair that is suitable for travel and leisure and that can be used in a variety of environments including, for example, in households, outdoors, and in a garden.

BACKGROUND ART

The existing folding chair suitable for travel and leisure mainly has two structures. One uses an assembly-type structure composed of multiple U-shaped rectangular frames, with the chair fabric being stretched tight. This is comfortable for sitting and resting, but has a large volume when folded, and thus is inconvenient for carrying and depositing. The other uses a plurality of crossed supports connected together, and has a small volume when folded, but its arms are soft because the chair fabric is connected to the chair support frame via some fixing points and therefore cannot be easily stretched tight. When a person sits in the chair, the person is likely to sink undesirably, thus causing poor comfort. In addition, the chair body support structure has poor strength and therefore can bear only a relatively small load. Thus, after a period of use or upon bearing a heavy load, the chair surface is likely to tear.

SUMMARY OF THE INVENTION

The present invention provides a portable folding chair that overcomes the above drawbacks. In one embodiment, the portable folding chair includes a chair support frame, rigid arms, a seating plane, front support legs, and rear support legs. The chair support frame forms an inverted V-shaped support structure when unfolded and is merged together when folded, with front and rear crossed tubes being connected to the front and rear V-shaped support legs, and the back-rest tubes and seating frame tubes being connected to and sleeved over the rear support legs. The entire chair can be folded at once by means of the front and rear crossed tubes, various movable blocks and rotating elements, and occupies a small volume after being folded, and is therefore convenient for carrying. Meanwhile, the chair fabric is sleeved over the seating frame tubes and back-rest tubes, and the fabric is stretched tight naturally by human body's weight when a person sits on the chair, with the force being distributed uniformly.

In one embodiment, the portable folding chair structure includes a chair support frame, a surface fabric, a backrest, arms, seating frame tubes, back-rest tubes, arm front support tubes, front support legs, front cross tubes, rear support legs, connection sliding blocks, locking sliding blocks, arm sliding blocks, rear cross tubes, locking fixtures, fixing elements, sliding locating blocks, rotating support blocks, U-shaped hinging pieces, and plastic shoes. The rear support legs are connected to the front support legs through the rotating support blocks. Each of the seating frame tubes and back-rest tubes are connected to one of the rear support legs through one of the connection sliding blocks, such that they can slide freely along the rear support legs. The middle portion of each of the seating frame tubes is connected to the middle portion of one of the front support legs. The upper end of each of the front cross tubes is fixed to one of the fixing elements of one of the seating frame tubes via one of the U-shaped hinging pieces, and the lower end of each of the front cross tubes is fixed to one of the locking fixtures on one of the front support legs via one of the U-shaped hinging pieces. The upper end of each of the rear cross tubes is fixed to one of the sliding locating blocks on one of the back-rest tubes via one of the U-shaped hinging pieces, and the lower end of each of the rear cross tubes is connected to one of the rear support legs via one of the U-shaped hinging pieces. Both the front support legs and the rear support legs are equipped with plastic shoes. The fabric is fixed to the chair support frame through the seating frame tubes and the back-rest tubes. The lower end of each of the arm front support tubes is connected to one of the locking sliding blocks sleeved on one of the front support legs, and the middle portion of each of the arm front support tubes is connected to one of the fixing elements. The front end of each of the arms is connected to the upper end of one of the arm front support tubes, and the rear end of each of the arms is fixed to the upper portion of one of the front support legs via one of the arm sliding blocks slidably mounted in the sliding groove located under each of the arms.

When a person wants to use the portable folding chair of this invention, he can hold the front end of the seating frame tube, and pull the upper end of the back-rest tube toward both sides to bring the front cross and rear cross tubes rotationally open, and to make the rear support leg rotate outwards. At the same time the front support tube of the arm slides downward along the front support leg. When the rotating support block on the rear support leg gets stuck in the front support leg, the support frame is fully opened, and the folding chair is ready for use. To fold the chair, one can fold inward the seating frame tube and back-rest tube to make the arm front support tube slide upward along the front support leg through the arm and the locking sliding block of the front support tube, then push the front end of the arm backward so that the arm slides backward along the arm sliding block located under the arm tube. At the same time, the front and rear cross tubes are folded inward to collapse the support frame into the folded position. Once the chair is folded, the chair may be put into a bag for convenient carrying.

Compared with the prior art, the portable folding chair of this invention has the following advantages and characteristics:

1. When the support frame is unfolded, it has numerous locking points, and when rotating the fixture and the arm support tube locking element, the support frame has a uniform force distributed all over, with a stable structure;

2. The arms can slide backward, and thus the chair can be packed in a small volume;

3. The locking of the arm front support tube makes the arms completely fixed, and thus provides good stability; and 4. The support frame can be folded and unfolded all at once, and is therefore easy to fold and unfold.

DETAILED DESCRIPTION OF THE INVENTION

In the following discussion, the present invention will be further described in conjunction with the drawings.

Figure 1:
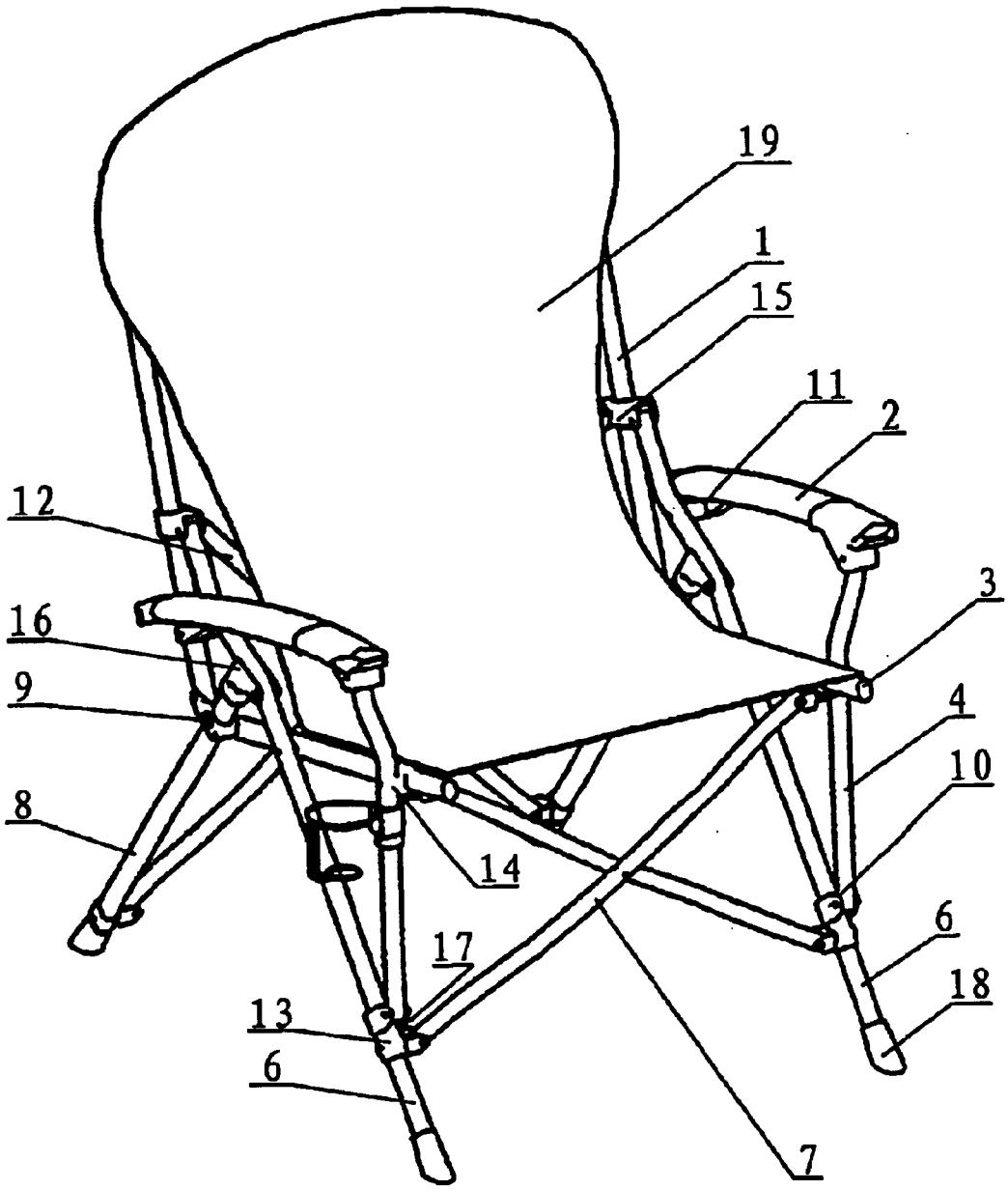
FIG. 1 is a schematic diagram of the structure of a portable folding chair according to one embodiment of this invention.
Figure 2:
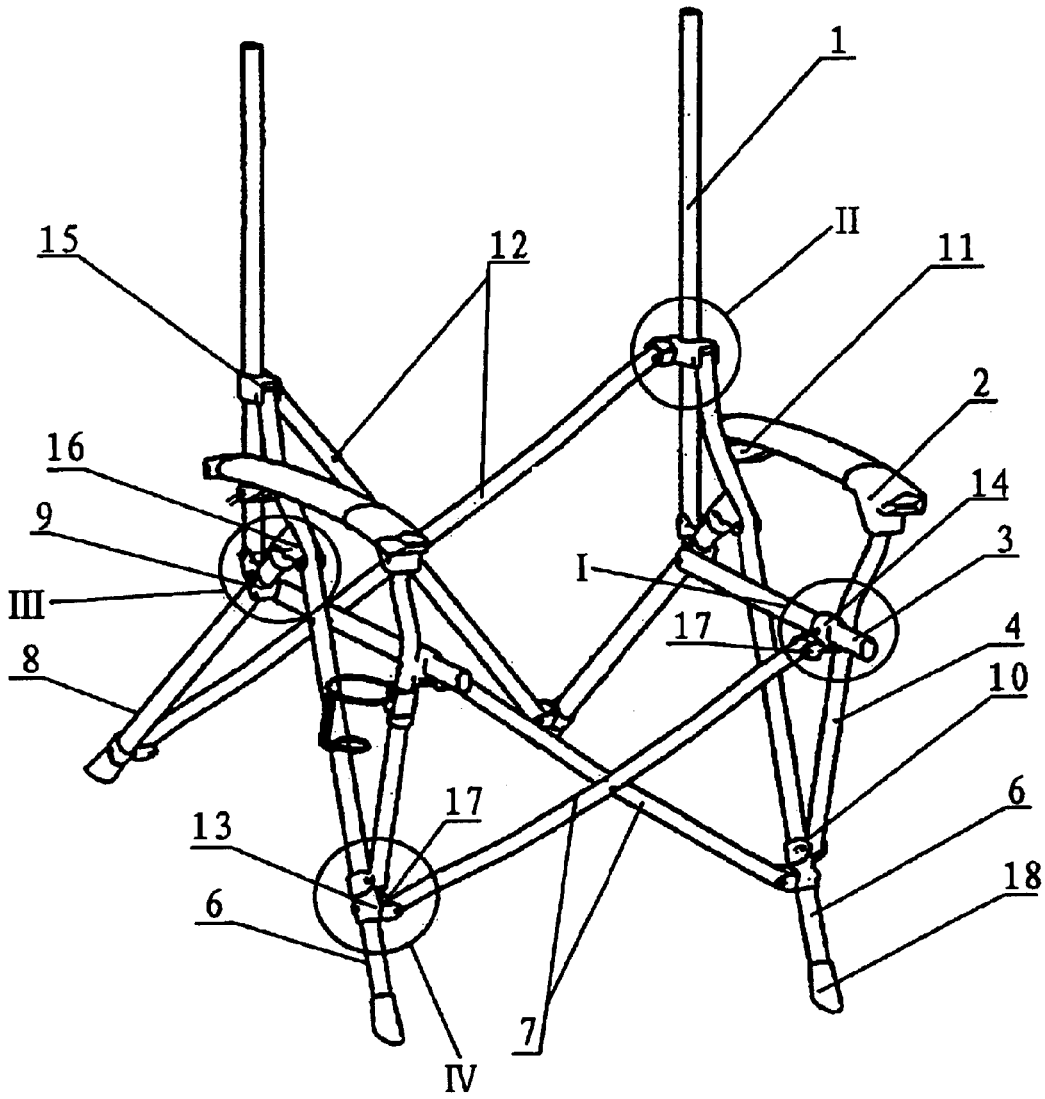
FIG. 2 is a schematic diagram of the support frame of a portable folding chair according to this invention.
Figure 3:
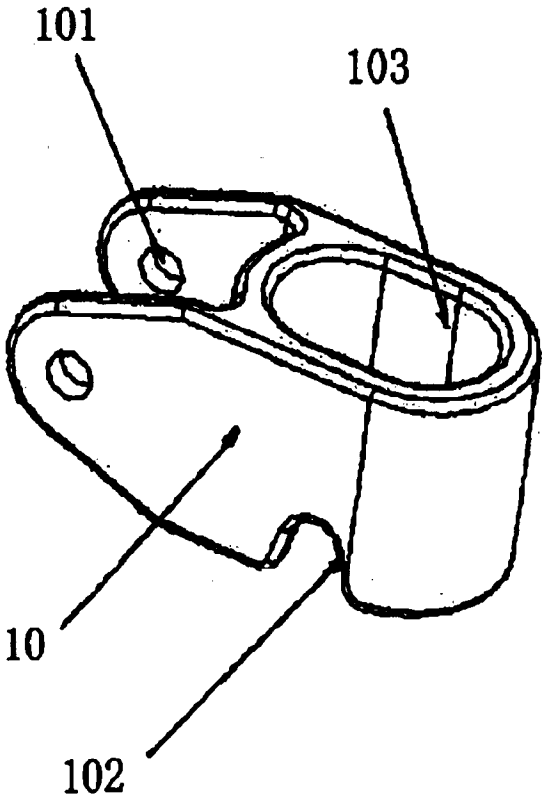
FIG. 3 is a schematic diagram of the locking sliding block in a portable folding chair according to this invention.

FIGS. 1 and 2 show a portable folding chair of this invention. The portable folding chair of this invention includes a support frame, chair surface 19, back-rest tube 1, arm 2, seating frame tube 3, arm front support tube 4, front support leg 6, front cross tube 7, rear support leg 8, connection sliding block 9, locking sliding block 10, arm sliding block 11, rear cross tube 12, locking fixture 13, fixing element 14, sliding locating block 15, rotating support block 16, U-shaped hinging piece 17, and plastic shoe 18.

FIGS. 3–6 are schematic views of locking sliding block 10, locking fixture 13, connection sliding block 9, and sliding locating block 15, respectively, in the portable folding chair according to this invention. It can be seen from FIG. 3, the main body of locking sliding block 10 is a ring, and the ring is provided with a sliding hole 103, which is sleeved on the front support leg 6 (see FIGS. 1 and 2). At the perimeter of the ring is provided two wings extending in parallel along the radial direction of sliding hole 103, and the two wings are symmetrically disposed with pivoting holes 101. Two recesses 102 are correspondingly disposed at the lower edge of the ring of locking sliding block 10.

Figure 4:
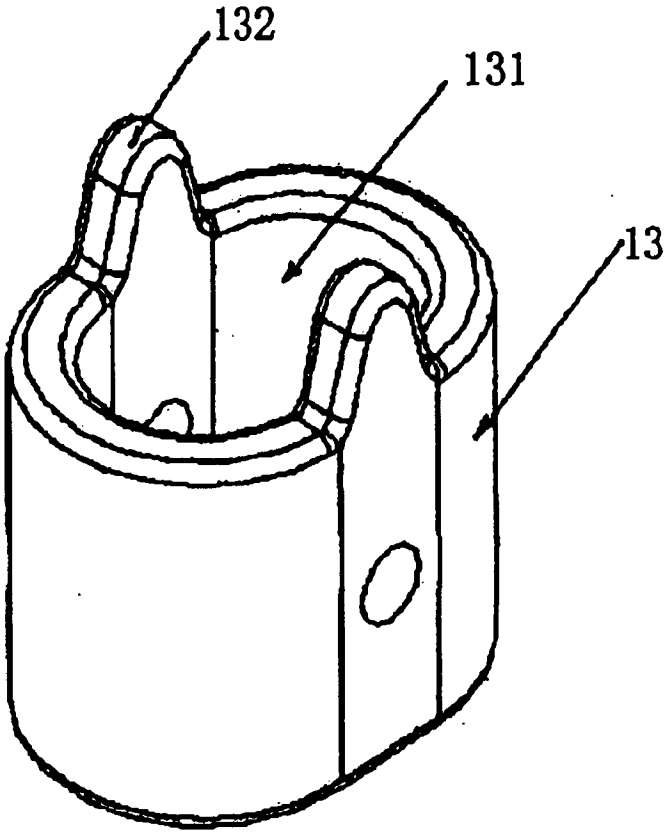
FIG. 4 is a schematic diagram of the locking fixture of a portable folding chair according to this invention.

Referring to FIG. 4, the main body of the locking fixture 13 of this invention is a ring, in which is provided a hole 131, which is sleeved and fixed to the front support leg 6 (see FIGS. 1 and 2). Two protrusions 132, which extend in parallel with the axial direction of the hole 131, are provided at the two sides of the top of the locking fixture 13.

Figure 5:
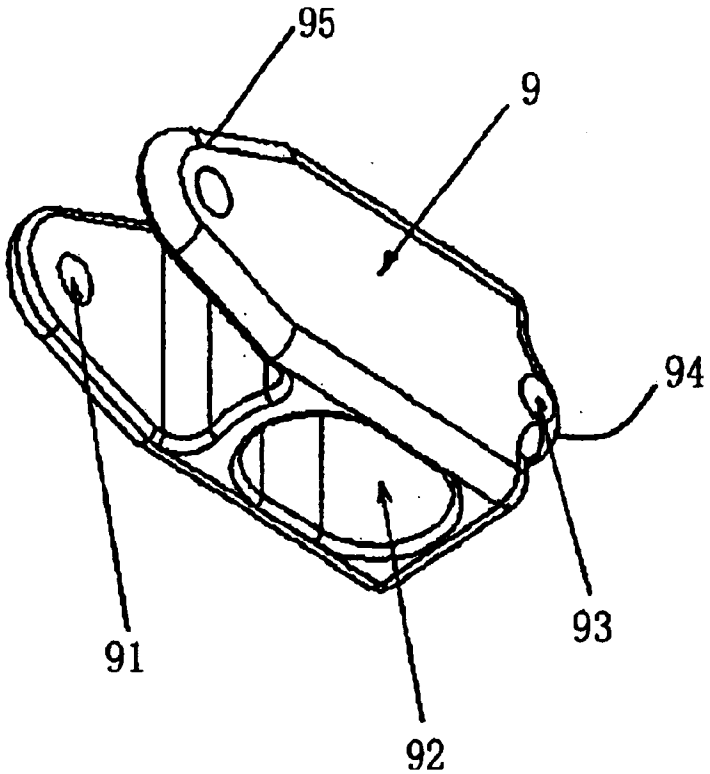
FIG. 5 is a schematic diagram of the connection sliding block of a portable folding chair according to this invention.

Referring to FIG. 5, the main body of the connection sliding block 9 is a ring, and the ring is disposed with a sliding hole 92, which is mounted on the rear support leg 8. Two parallel projections 94 extending along the radial direction of the sliding hole 92 are provided at one end of the perimeter of the ring of connection sliding block 9. The projections 94 are correspondingly disposed with pivoting holes 93. Two parallel wings 95 extending along the radial direction of the sliding hole 92 are provided at the other end of the perimeter of the ring of connection sliding block 9. The wings 95 are correspondingly disposed with pivoting holes 91. As shown in FIGS. 1 and 2, seating frame tube 3 and back-rest tube 1 are respectively connected to the pivoting holes 93, 91 of the connection sliding block 9.

Figure 6:
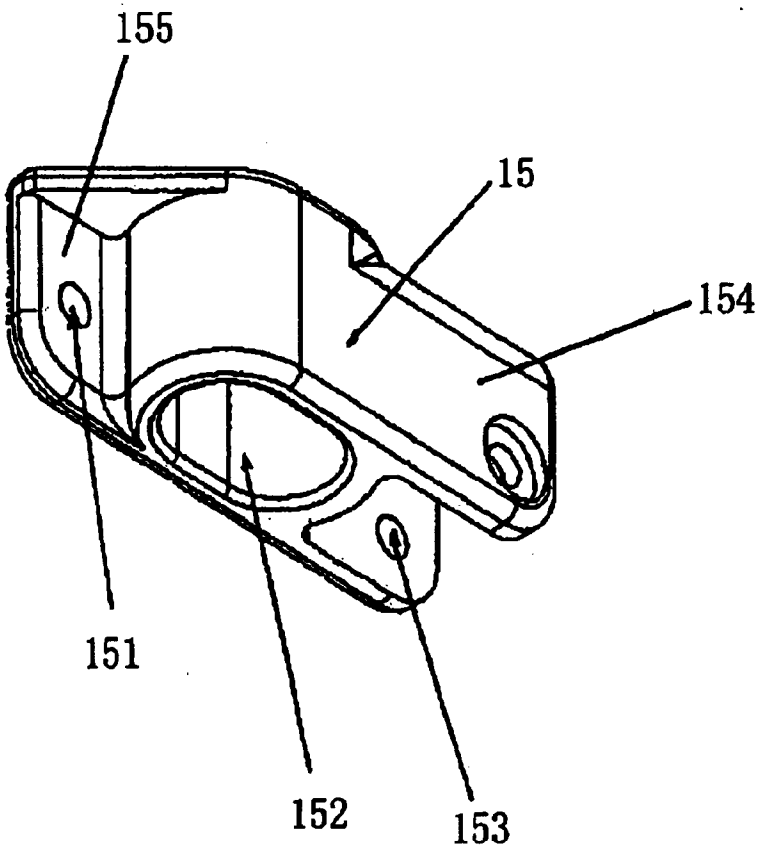
FIG. 6 is a schematic diagram of the slidable locating block of a portable folding chair according to this invention.

Referring to FIG. 6, in the middle portion of the sliding locating block 15 is provided sliding hole 152, and the sliding hole 152 is sleeved on the back-rest tube 1, which can slide up and down freely. Two parallel wings 154 extending along the radial direction of sliding hole 152 are provided at one end of the sliding locating block 15, and at the wings are symmetrically provided pivoting holes 153. At the other end of the sliding locating block 15 is provided an extending wing 155, which extends along the radial direction of sliding hole 152. The extending wing 155 is disposed with another pivoting hole 151. As shown in FIGS. 1 and 2, the upper end of the rear cross tube 12 is connected to the pivoting hole 151 on the sliding locating block 15 via a U-shaped hinge 17.

FIGS. 7–10 are the local schematic views of the connection relationships and structures of the fixing element 14, sliding locating block 15, connection sliding block 9, rotating support block 16, locking sliding block 10, and locking fixture 13.

Figure 9:
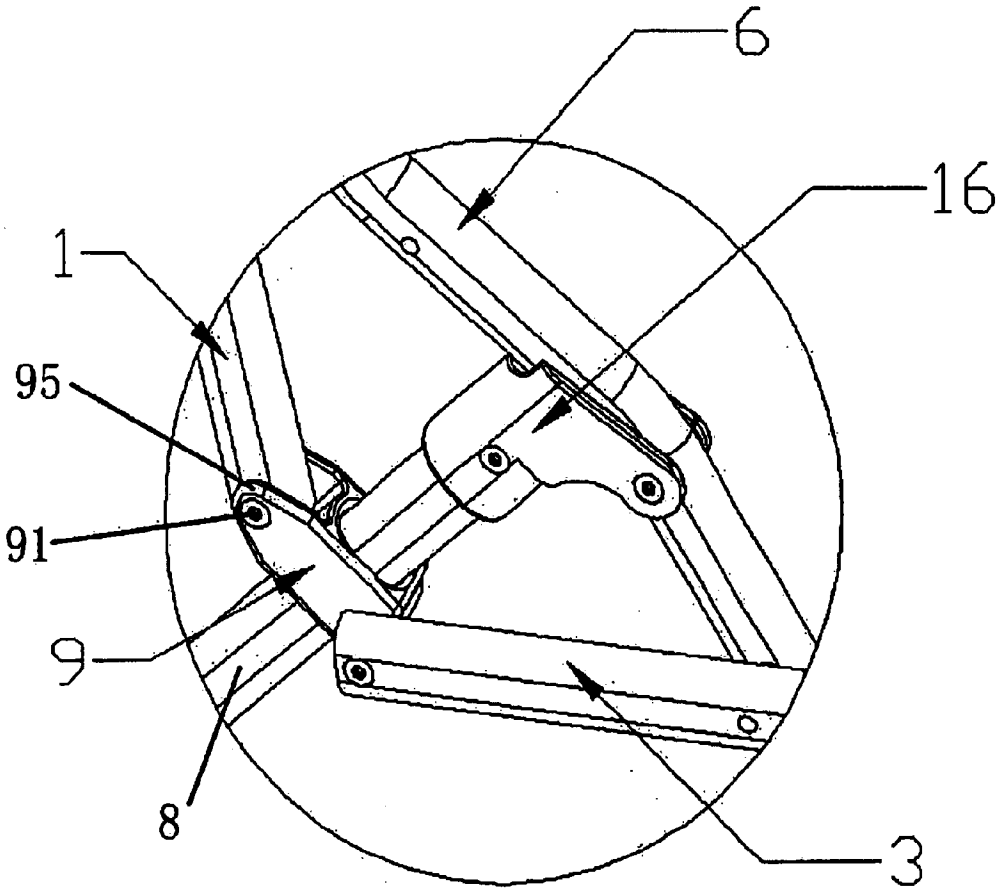
FIG. 9 is a schematic diagram of the local amplification of portion III in FIG. 2, showing the connection state of the rotating support block.
Figure 10:
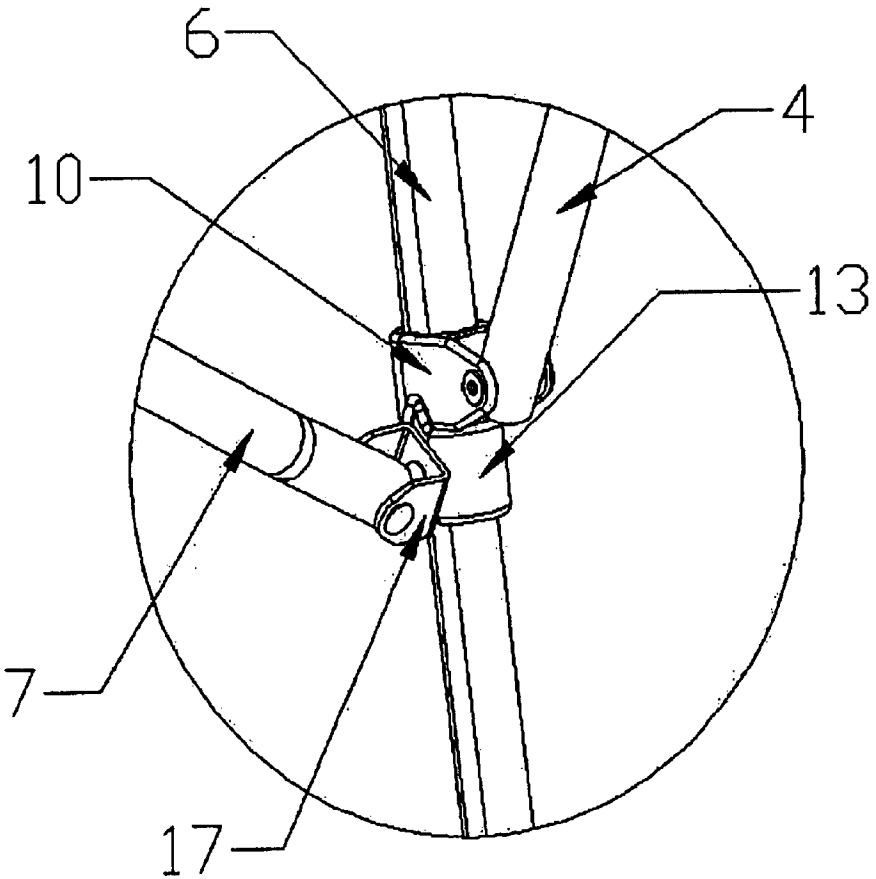
FIG. 10 is a schematic diagram of the local amplification of portion IV in FIG. 2, showing the connection state of the locking sliding block and locking fixture.

Referring to FIGS. 1, 2 and 9, the rear support leg 8 is connected to the front support leg 6 via a rotating support block 16. The seating frame tube 3 and back-rest tube 1 are respectively connected to the pivoting holes 93 and 91 of the connection sliding block 9. The sliding hole 92 of the connection sliding block 9 is sleeved on the rear support leg 8, and connected to the rear support leg 8 via connection sliding block 9. The seating frame tube 3 and back-rest tube 1 can slide freely along the rear support leg, and the middle portion of the seating frame tube 3 is connected to the middle portion of the front support leg 6 (see FIG. 7). The upper ends of the front cross tubes 7 are fixed to the fixing elements 14 of the seating frame tube 3 respectively via a U-shaped hinging piece 17, and the lower ends are fixed respectively to the locking fixtures 13 of the two front support legs 6 via a U-shaped hinging piece 17. The hole 131 on the main body of the locking fixture 13 is sleeved and fixed to the lower portion of the front support leg 6 such that the projections 132 are in an upward orientation, as shown in FIG. 10.

Figure 7:
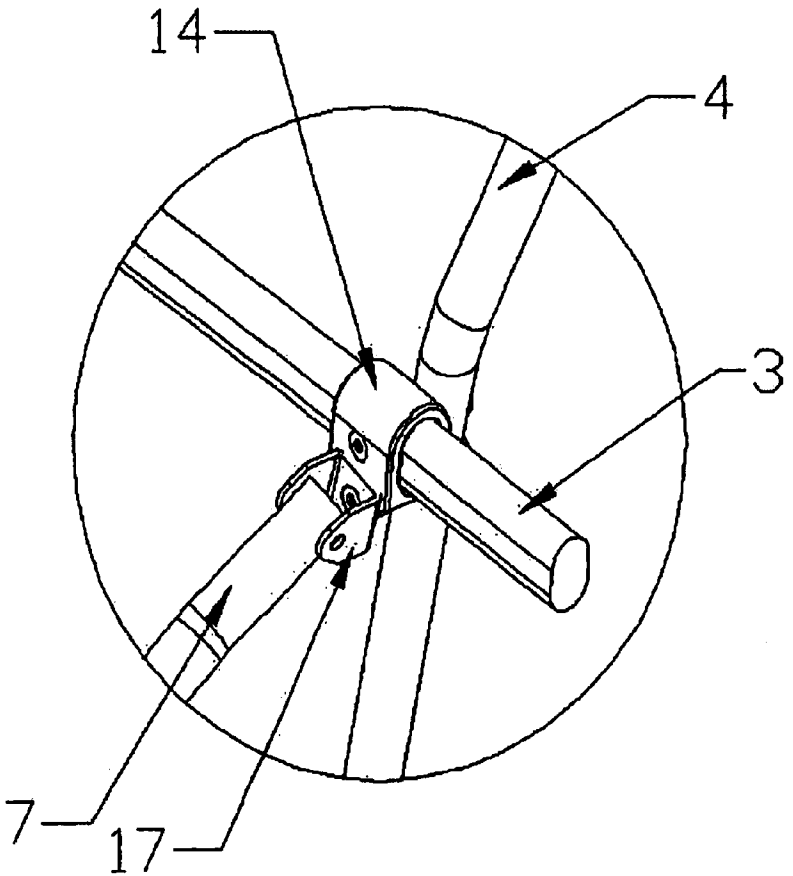
FIG. 7 is a schematic diagram of the local amplification of portion I in FIG. 2, showing the connection state of the fixture.
Figure 8:
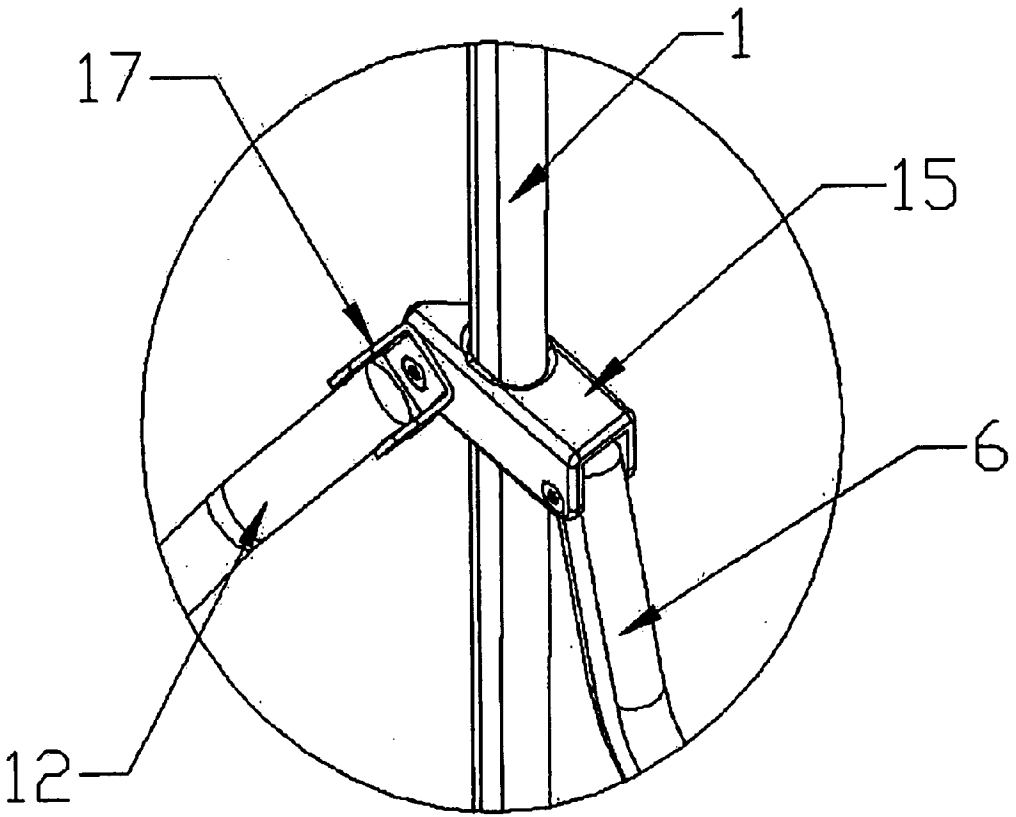
FIG. 8 is a schematic diagram of the local amplification of portion II in FIG. 2, showing the connection state of the slidable locating block.

As shown in FIGS. 1, 2 and 8, the upper ends of the rear cross tubes 12 are connected respectively to the pivoting hole 151 on the sliding locating block 15 via another U-shaped hinging piece 17. The sliding hole 152 of the sliding locating block 15 is sleeved on the back-rest tube 1 and can slide up and down freely. Another pivoting hole 153 on the sliding locating block 15 is pivoted to the upper end of the front support leg 6, and the lower ends of the rear cross tubes 12 are connected respectively to the rear support leg 8 via another U-shaped hinging piece 17. The lower ends of the front support leg 6 and rear support leg 8 are equipped with plastic shoes 18. The chair surface 19 is fixed to the chair support frame via the seating frame tube 3 and back-rest tube 1, and the lower end of the arm support tube 4 is connected to the pivoting hole 101 on the locking sliding block 10. The sliding hole 103 on the locking sliding block 10 is sleeved on the front support leg 6, and the recess 102 thereon is in a downward orientation. The middle portion of the arm support tube 4 is connected to the fixing element 14 (as shown in FIG. 7). The front end of the arm 2 is connected to the upper end of the arm front support tube 4, and the rear end is connected to the upper portion of the front support leg 6 via the slidable arm sliding block 11 mounted in the sliding groove under the arm 2.

The portable folding chair will be an inverted V-shaped structure when the front and rear support legs are unfolded, and will be drawn in when folded, because the chair is all connected by cross tubes and support legs. The portable folding chair of this invention is a symmetrical structure, and therefore it will be apparent to one skilled in the art that the opposing sides of the chair are symmetrically configured even if that is not explicitly stated herein.

To use the portable folding chair of this invention, one can hold the front end of the seating frame tube 3, and pull the upper end of the back-rest tube 1 toward both sides to bring the front cross tube 7 and rear cross tube 12 rotationally open, and to make the rear support leg 8 rotate outwards. At the same time the front support tube 4 of the arm slides downward along the front support leg 6. When the rotational support block 16 on the rear support leg 8 gets stuck in the front support leg, as shown in FIG. 10, and when the recess 102 is arranged downward and sleeved through the locking sliding block 10 of the front support leg and is fitted tight with the protrusion 132 arranged upward on the locking fixture 13 at the lower portion of the front support leg 6, the support frame is fully opened, and the folding chair is ready for use. To fold the chair, one can fold inward the seating frame tube 3 and back-rest tube 1 to make the arm front support tube 4 slide upward along the front support leg 6 through the arm 2 and the locking sliding block 10 of the front support tube, then push the front end of the arm backward so that the arm 2 slides backward along the arm sliding block 11 located under the arm 2. At the same time, the front and rear cross tubes 7, 11 are drawn in to fold the support frame. Once the chair is folded, the chair may be put into a bag for convenient carrying.

The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A portable folding chair, comprising:

a chair support frame, a surface fabric, a backrest, arms, and shoes, wherein said chair support frame includes seating frame tubes, back-rest tubes, arm front support tubes, front support legs, front cross tubes, rear support legs, connection sliding blocks, locking sliding blocks, arm sliding blocks, rear cross tubes, locking fixtures, fixing elements, sliding locating blocks, rotating support blocks, and U-shaped hinging pieces, said rear support legs are connected to said front support legs via said rotating support blocks, each of said seating frame tubes and each of said back-rest tubes are connected to one of said rear support legs via one of said connection sliding blocks and can slide freely along said rear support legs, a middle portion of each of said seating frame tubes is connected to a middle portion of one of said front support legs, an upper end of each of said front cross tubes is connected to one of said fixing elements of each of said seating frame tubes via one of said U-shaped hinging pieces, and a lower end of each of said front cross tubes is connected to one of said locking fixtures on one of said front support legs via one of said U-shaped hinging pieces, an upper end of each of said rear cross tubes is fixed to one of said sliding locating blocks on one of said back-rest tubes via one of said U-shaped hinging pieces, and a lower end of each of said rear cross tubes is connected to one of said rear support legs via one of said U-shaped hinging pieces, a lower end of each of said arm front support tubes is connected to one of said locking sliding blocks sleeved on one of said front support legs, a middle portion of each of said arm front support tubes is connected to one of said fixing elements, and a front end of each of said arms is connected to an upper end of one of said arm front support tubes, and a rear end of each of said arms is connected to an upper portion of one of said front support legs via one of said arm sliding blocks slidably mounted in a sliding groove located under each of said arms.

2. A portable folding chair according to claim 1, wherein said surface fabric is fixed to said chair support frame through said seating frame tubes and said back-rest tubes.

3. A portable folding chair according to claim 1, wherein each of said front support legs and each of said rear support legs are equipped with shoes, and wherein said shoes are plastic shoes.

4. A portable folding chair according to claim 1, wherein said front support legs and said rear support legs form an inverted V-shaped support structure when unfolded, and said front support legs and said rear support legs are drawn in when folded, and wherein the entire chair is connected by cross tubes and inverted V-shaped support legs.

5. A portable folding chair according to claim 1, wherein each of said locking sliding blocks is provided with a sliding hole sleeved on the front support leg, at a perimeter of said sliding hole is provided two wings extending in parallel along a radial direction of said sliding hole, the two wings being symmetrically disposed with pivoting holes, and two recesses are correspondingly disposed at a lower edge of each of said locking sliding blocks.

6. A portable folding chair according to claim 1, wherein each of said locking fixtures is provided with a hole sleeved and fixed to one of said front support legs, and two protrusions extending in parallel with an axial direction of said hole are provided at two sides of the top of said hole.

7. A portable folding chair according to claim 1, wherein each of said connection sliding blocks is disposed with a sliding hole, at one end of a perimeter of each sliding hole is provided two parallel protrusions extending along a radial direction of said sliding hole, each of said protrusions being correspondingly disposed with pivoting holes, and at the other end of the perimeter of each sliding hole is provided two parallel wings extending along the radial direction of said sliding hole, each of said wings being symmetrically disposed with another pivoting hole, and wherein each of said seating frame tubes and said back-rest tubes are respectively connected to said pivoting holes of each of said connection sliding blocks.

8. A portable folding chair according to claim 1, wherein a middle portion of each of said sliding locating blocks is provided with a sliding hole, each sliding hole being sleeved on one of said back-rest tubes and being freely slidable up and down one of said back-rest tubes, at one end of each of said sliding locating blocks is provided two parallel wings extending along a radial direction of each sliding hole, each of said two wings being symmetrically provided with pivoting holes, and at the other end of each of said sliding locating blocks is provided an extending wing extending along said radial direction of each sliding hole, said extending wing being disposed with another pivoting hole.

* * * * *